US009784061B2

(12) United States Patent
Al-Fahad

(10) Patent No.: US 9,784,061 B2
(45) Date of Patent: Oct. 10, 2017

(54) BORE HOLE TRACER INJECTION APPARATUS

(71) Applicant: KUWAIT INSTITUTE FOR SCIENTIFIC RESEARCH, Safat (KW)

(72) Inventor: Khaled Gh. M. Al-Fahad, Qurtuba (KW)

(73) Assignee: KUWAIT INSTITUTE FOR SCIENTIFIC RESEARCH, Safat (KW)

( * ) Notice: Subject to any disclaimer, the term of this patent is extended or adjusted under 35 U.S.C. 154(b) by 347 days.

(21) Appl. No.: 14/727,740

(22) Filed: Jun. 1, 2015

(65) Prior Publication Data

US 2016/0348454 A1 Dec. 1, 2016

(51) Int. Cl.

| | |
|---|---|
| ***E21B 27/02*** | (2006.01) |
| ***E21B 34/14*** | (2006.01) |
| *E21B 34/00* | (2006.01) |

(52) U.S. Cl.

CPC ..... *E21B 27/02* (2013.01); *E21B 34/14* (2013.01); *E21B 2034/007* (2013.01)

(58) Field of Classification Search

CPC ..... E21B 27/02; E21B 34/14; E21B 2034/007
USPC ..... 166/169
See application file for complete search history.

(56) References Cited

U.S. PATENT DOCUMENTS

| | | | | |
|---|---|---|---|---|
| 2,385,378 A | | 9/1945 | Petty | |
| 2,904,112 A | | 9/1959 | Wiley | |
| 3,248,540 A | | 4/1966 | Youmans | |
| 3,395,277 A | | 7/1968 | Mayer, Jr. et al. | |
| 4,558,219 A | | 12/1985 | LeBlanc et al. | |
| 4,864,128 A | | 9/1989 | Priest | |
| 5,635,712 A | | 6/1997 | Scott, III et al. | |
| 5,823,398 A | * | 10/1998 | Russillo | A47G 19/34 222/185.1 |
| 2013/0161017 A1 | * | 6/2013 | King | E21B 34/103 166/318 |
| 2015/0090453 A1 | * | 4/2015 | Tolman | E21B 33/138 166/297 |

FOREIGN PATENT DOCUMENTS

| | | |
|---|---|---|
| GB | 1156082 | 6/1969 |

* cited by examiner

*Primary Examiner* — Taras P Bemko
(74) *Attorney, Agent, or Firm* — Richard C. Litman

(57) ABSTRACT

The bore hole tracer injection apparatus is a mechanical device for inserting a tracer agent into a bore hole at a predetermined depth. Outer and inner cylinders have side ports, with the side ports of the cylinders misaligned to prevent fluid escape from the inner cylinder until desired. The bottom of the inner cylinder includes a filler passage. A line passes through the top of the outer cylinder and attaches to a rod across the top of the inner cylinder, above the closed top thereof. The inner cylinder is filled with a tracer agent, and the apparatus is lowered into the bore hole to the desired depth. A weight is then dropped down the line, and jars the outer cylinder down around the inner cylinder when it contacts the top of the outer cylinder. This aligns the side ports of the cylinders to allow escape of the tracer agent therefrom.

18 Claims, 3 Drawing Sheets

BORE HOLE TRACER INJECTION APPARATUS

BACKGROUND OF THE INVENTION

1. Field of the Invention

The present invention relates generally to tools and equipment for earthen boring and subterranean wells, and particularly to a bore hole tracer injection apparatus for remotely releasing a tracer agent in the downhole of a well.

2. Description of the Related Art

The underground movement of certain fluids is of considerable importance in various fields. An example is found in the field of groundwater aquifers, where it is critical under certain conditions to determine both the direction and the velocity of subsurface flow. This is important in determining where to locate a water well(s), the possible contamination of subsurface water sources, and for various other reasons.

One of the means for determining such direction and velocity of flow is by drilling or otherwise forming a borehole, lowering a radioactive tracer agent into the borehole, and releasing the tracer at a predetermined desired depth in the borehole. The radioactive tracer flows from the borehole with the subsurface flow, and may be detected through suitable radiation detection devices to determine the direction and velocity of flow. However, most of the equipment that has been developed for determining such subsurface flow is directed to the petroleum industry, and is relatively costly and complex.

Thus, a bore hole tracer injection apparatus solving the aforementioned problems is desired.

SUMMARY OF THE INVENTION

The bore hole tracer injection apparatus provides for the accurate delivery of a radioactive tracer material into a borehole at a predetermined depth, without need for costly or complex electronic mechanisms. The apparatus essentially comprises two concentric cylinders. The inner cylinder is closed with the exception of a series of ports in the side wall and a single hole in the bottom for filling the cylinder with a fluid, e.g., a radioactive tracer agent. The outer cylinder also has a series of ports in the side wall thereof, but is open at the bottom to allow the inner cylinder to be installed within the outer cylinder.

The outer cylinder also has a passage in its top wall to provide for the passage of a suspension line, e.g., a rope, cord, cable, wire, or similar flexible member therethrough. The suspension line is passed through the top opening or passage of the outer cylinder, and tied (or otherwise secured) to a rod that is secured diametrically across the top of the inner cylinder above its closed top wall. The rod extends through two of the side ports of the outer cylinder to assure that the two cylinders do not rotate relative to one another.

The apparatus is used by installing the inner cylinder partially within the outer cylinder, such that there is some space or distance between the top of the inner cylinder and the inner top of the outer cylinder. In this manner, the ports of the outer cylinder and the inner cylinder are misaligned and fluid cannot flow from the inner cylinder. In other words, the outer cylinder acts as a closure for the inner cylinder. Circumferential O-rings are provided about the outer surface of the inner cylinder and the inner surface of the outer cylinder to seal any gap that may exist between the two cylinders. The inner cylinder is then filled with a suitable tracer agent and its filler port is plugged.

The apparatus may then be lowered into a borehole to the desired depth, according to the length of line or cord that is paid out. When the apparatus has reached the desired depth, a weight is dropped down the suspension line and contacts the top of the outer cylinder. This jars the outer cylinder downward until its top wall contacts the top of the inner cylinder, whereupon the side ports of the outer cylinder and inner cylinder are aligned with one another. This allows the tracer agent to escape from the device to flow into the subsurface aquifer or other subsurface liquid for tracing the direction and velocity of flow of the liquid using suitable detection equipment. The assembly is then drawn upward from the borehole for reuse as desired.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The bore hole tracer injection apparatus provides a reliable, purely mechanical means for injecting a tracer agent, e.g., a radioactive liquid, etc., into the bore hole of a water or other well or downhole at a predetermined depth therein. Tracing the direction and velocity of the tracer agent as it infiltrates the subsurface aquifer or other liquid deposit enables the technician to determine the corresponding location and direction of flow of the water or other liquid below the surface.

Figure 1:
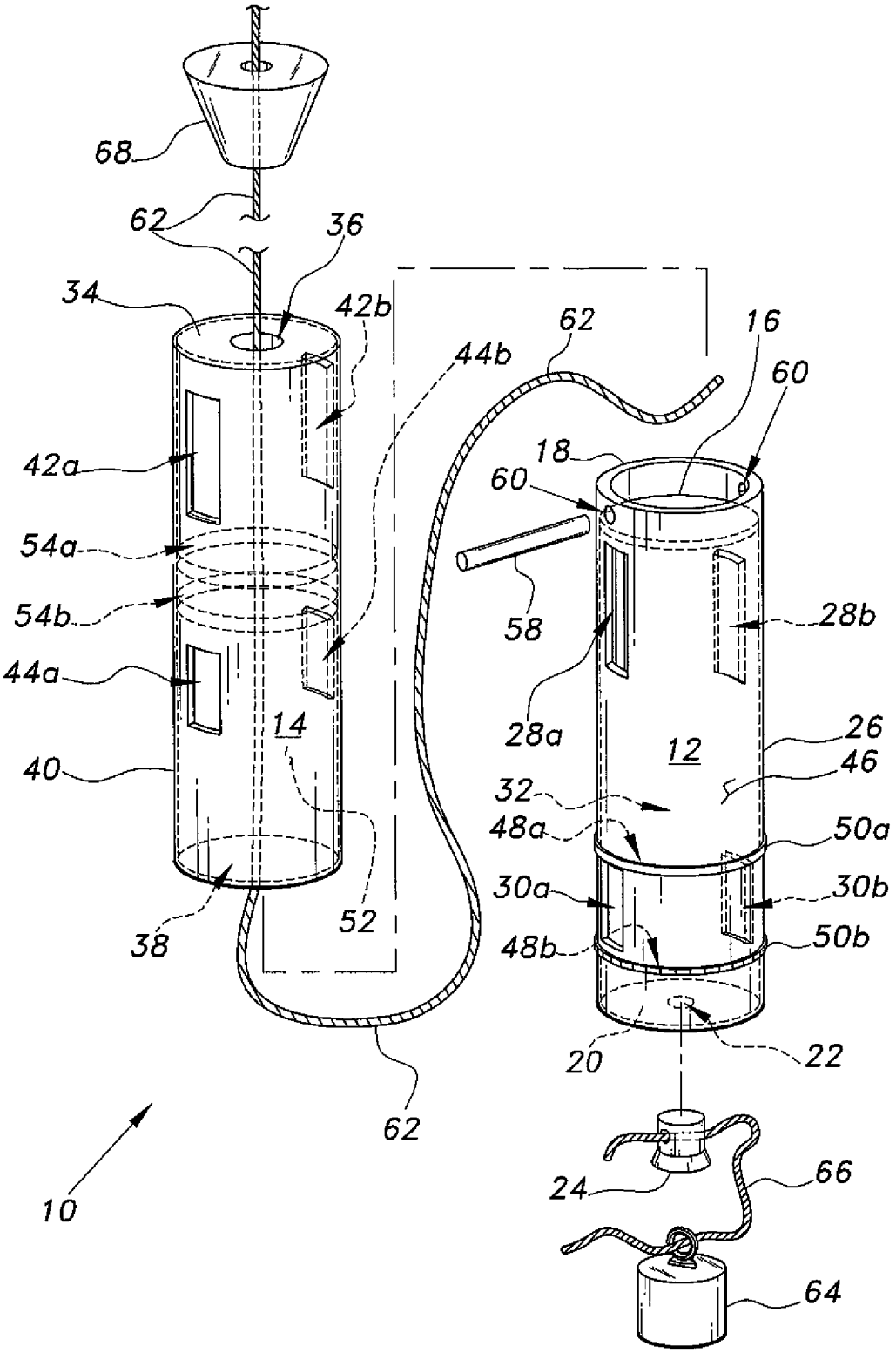
FIG. 1 is an exploded perspective view of a bore hole tracer injection apparatus according to the present invention, illustrating its various components and features.

FIG. 1 of the drawings provides an exploded perspective view of the components of the borehole tracer injection apparatus 10. The apparatus 10 includes an inner cylinder 12 that installs axially and concentrically within an outer cylinder 14. The inner cylinder 12 has a closed top wall 16 with a top 18, i.e., an extension of the cylinder 12, extending above the top wall 16, and a bottom wall 20 with a filler port 22 formed therethrough. A plug 24, e.g., resilient member, cooperatively threaded, etc., is used to selectively close and seal the filler port 22 as required for operation of the apparatus 10. The side wall 26 of the inner cylinder 12 includes a plurality of tracer agent dispensing ports formed therethrough, with the dispensing ports preferably comprising a pair of diametrically opposed upper ports 28*a*, 28*b*, and a pair of diametrically opposed lower ports 30*a*, 30*b*. The cylindrical side wall 24, along with the closed top wall 16 and the bottom wall 20, define a tracer agent container 32 therein.

The outer cylinder 14 has a top wall 34 with a suspension line clearance passage 36 disposed therethrough, an open bottom 38, and a circumferential side wall 40. The side wall 40 includes a plurality of tracer agent dispensing ports formed therethrough, as in the case of the inner cylinder 12. The ports of the outer cylinder 14 also preferably comprise a pair of diametrically opposed upper ports 42*a*, 42*b*, and a pair of diametrically opposed lower ports 44*a*, 44*b*. The outer cylinder ports 42*a* through 44*b* are located or positioned to align with the corresponding upper and lower ports 28*a* through 30*b* of the inner cylinder 12 when the inner cylinder 12 is inserted completely into the outer cylinder 14, as shown in FIG. 2B.

Figure 2A:
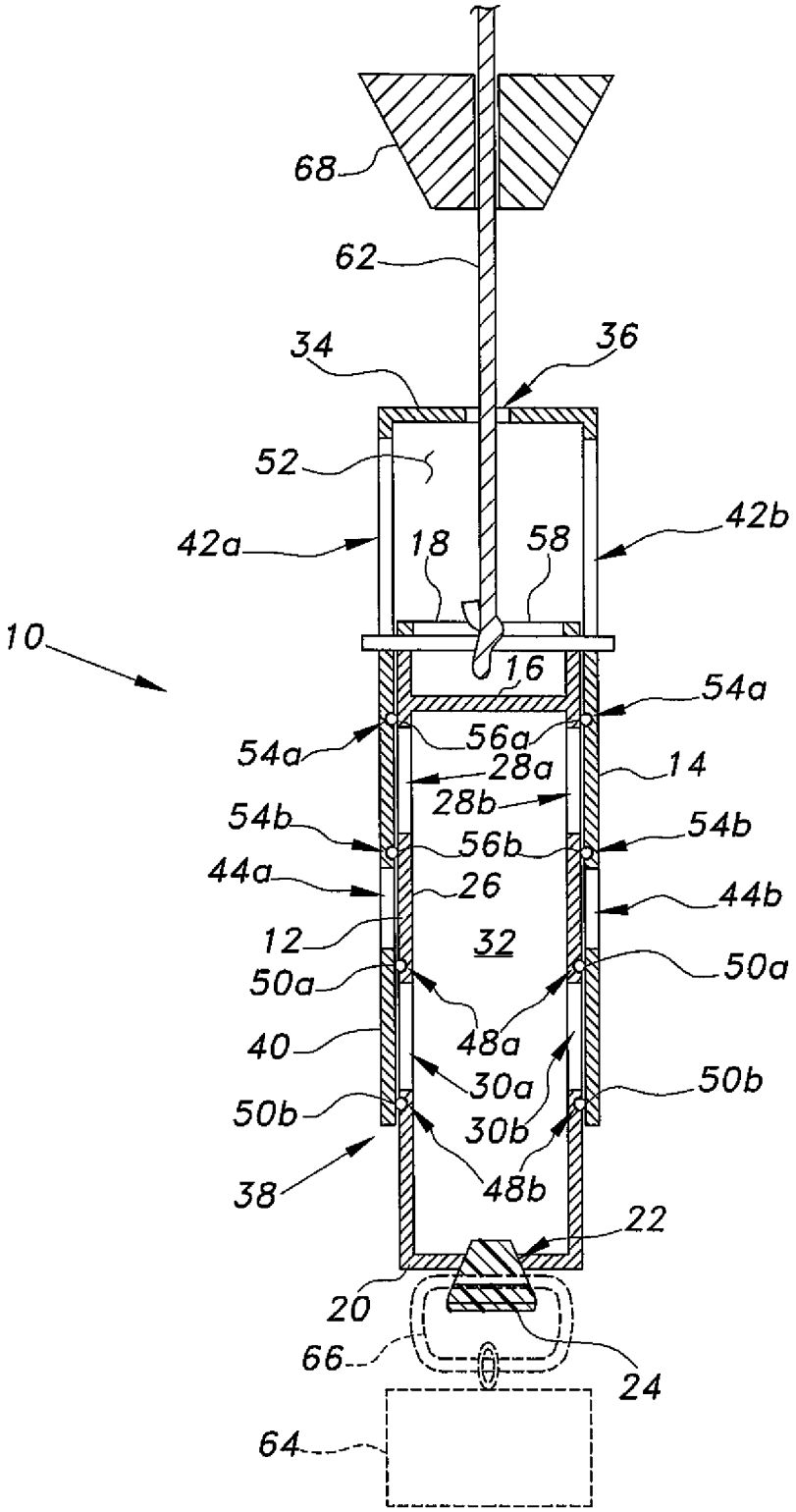
FIG. 2A is an elevation view in section of the bore hole tracer injection apparatus according to the present invention, showing the assembled apparatus prior to release of the tracer agent.
Figure 2B:
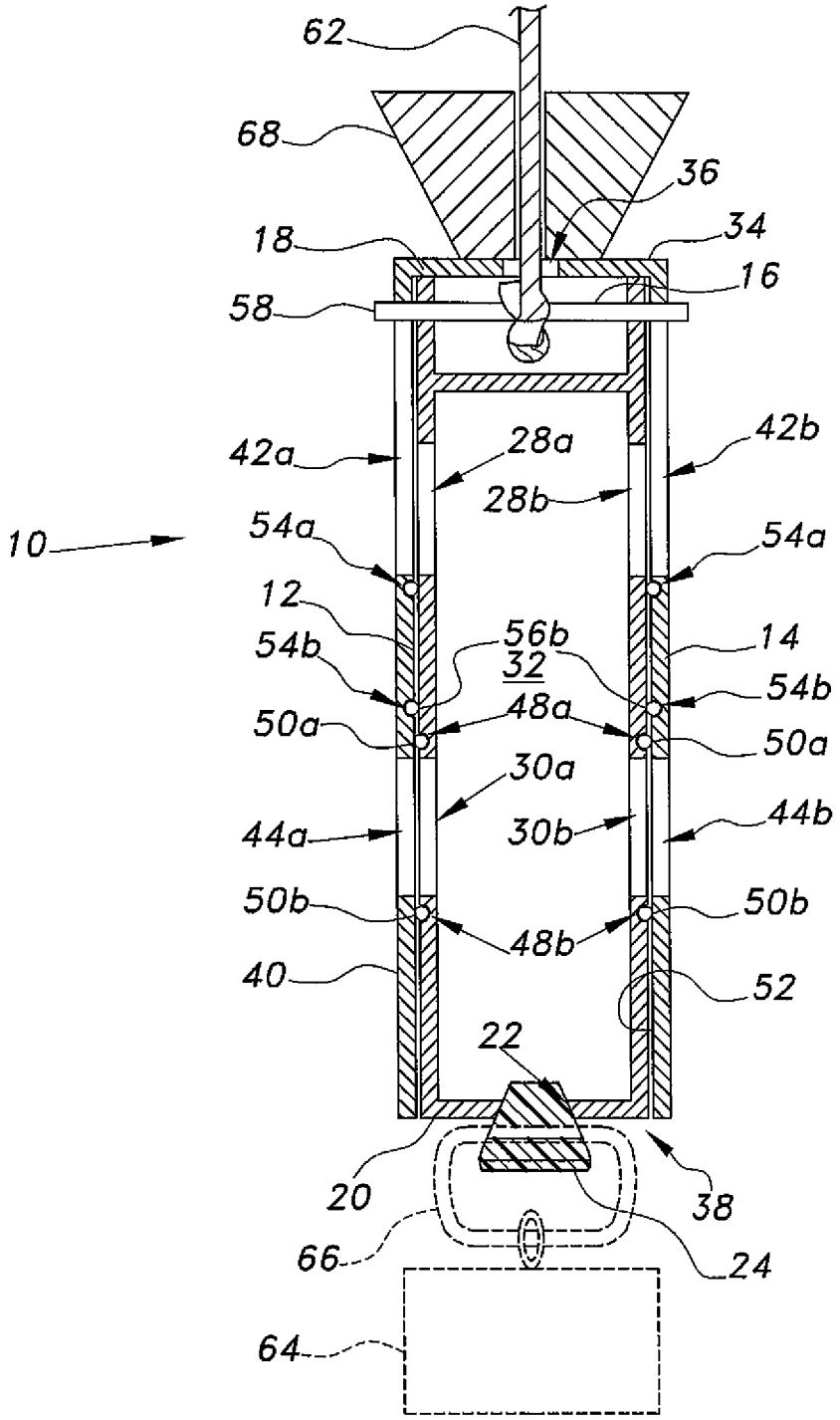
FIG. 2B is an elevation view in section of the bore hole tracer injection apparatus according to the present invention, showing the assembled apparatus after release of the tracer agent.

It will be seen in FIG. 2A that the tracer agent container 32 defined by the inner cylinder 12 is completely closed when the inner cylinder 12 is not completely inserted into the outer cylinder 14. In order to prevent leakage of the tracer agent between the two cylinder walls, a series of sealing rings, e.g., O-rings, etc., is installed between the two cylinders 12 and 14. The outer surface 46 of the inner cylinder 12 includes two circumferential sealing ring grooves 48*a*, 48*b* therearound, with a sealing ring, respectively 50*a* and 50*b*, seated in each of the grooves. Similarly, the inner surface 52 of the outer cylinder 14 includes two circumferential sealing ring grooves 54*a*, 54*h* therearound, with each of these grooves containing a sealing ring, respectively 56*a* and 56*b*. These 0-rings or other sealing rings seat and seal against the adjacent surface of the opposite cylinder to retain any tracer agent within the tracer agent container 32 of the inner cylinder 12 when the ports 28*a* through 30*b* of the inner cylinder 12 are not aligned with the ports 42*a* through 44*b* of the outer cylinder 14, as shown in FIG. 2A. The contact of the various seals or rings 50*a*, 50*b*, 56*a*, and 56*b* with the adjacent surface of the respective opposite cylinder also results in some frictional resistance to axial movement of the inner cylinder 12 with respect to the outer cylinder 14. This friction holds the inner cylinder 12 in position within the outer cylinder 14 as adjusted during preparation of the apparatus 10 for use, but is not sufficient to prevent movement between the two cylinders 12 and 14 if some moderate external axial force is applied.

FIG. 1 of the drawings provides an exploded perspective view showing the assembly of the various components of the borehole tracer injection apparatus 10. The apparatus 10 is assembled by inserting the inner cylinder 12 into the open bottom 38 of the outer cylinder 14 and sliding the inner cylinder 12 into the outer cylinder 14 until the top extension 18 of the inner cylinder 12 is visible through the upper ports 42*a*, 42*b* of the outer cylinder 14, generally as shown in FIG. 2B. A rod 58 is then inserted through one of the upper ports 42*a* or 42*b* of the outer cylinder and through a pair of diametrically opposed holes or passages 60 disposed through the top extension 18 of the inner cylinder 12, above the closed top wall 16 thereof. The ends of the rod 58 extend beyond the diameter of the inner cylinder 12 to reside in the two diametrically opposed upper ports 42*a*, 42*b* of the outer cylinder 14. In this manner, the inner and outer cylinders 12 and 14 are prevented from significant rotation relative to one another, and their respective ports are held in axial alignment with one another.

One end of a flexible suspension line 62, e.g., cord, wire, cable, etc., is then passed through the line clearance passage 36 through the top wall of the outer cylinder 14, and secured (e.g., tied, clipped, etc.) to the rod or pin 58 that is in turn secured to the top 18 of the inner cylinder 12. (A loop or other attachment may be formed in the end of the line 62 prior to inserting the end of the line into the upper end of the outer cylinder 12 and prior to installing the rod or pin 58 through the top 18 of the inner cylinder 12, with the rod or pin 58 then being installed to pass through the loop or other attachment of the line 62, if it is not possible to manipulate the end of the line 62 to form a loop or attachment when the line 62 end is inside the upper portion of the outer cylinder 14.)

At this point, the inner cylinder 12 is moved axially downward, i.e., away from the top wall 34 of the outer cylinder 14, so that the various side ports of the inner and outer cylinders 12 and 14 are not aligned with one another, generally as shown in FIG. 2A. The tracer agent container 32, i.e., the inner volume of the inner cylinder 12, may then be filled with a suitable tracer agent or other material as desired by removing the plug 24 from its filler port 22 in the bottom wall 20 of the inner cylinder 12 and filling the inner cylinder as desired. The plug 24 is then reinstalled in its filler port 22. It will be seen that the tracer agent container 32, i.e., the interior volume, of the inner cylinder 12 is sealed by the side wall 40 of the outer cylinder 14 due to the misalignment of the ports 28*a* through 30*b* of the inner cylinder 12 with the ports 42*a* through 44*b* of the outer cylinder 14 and the installation of the plug 24 in the filler port 22, as shown in FIG. 2A.

At this point the apparatus 10 may be lowered down the borehole by means of the flexible suspension line 62. The depth of the apparatus 10 is determined according to the length of the line 62 paid out, to position the apparatus 10 at the predetermined depth desired. A secondary weight 64 may be removably attached to the bottom of the inner cylinder 12 to depend therefrom, e.g., by a length of cord or other line 66 passed through a transverse hole in the plug 24, or other attachment means as desired. The secondary weight 64 is optional, as indicated by its illustration in broken lines in FIGS. 2A and 2B. The secondary weight 64 serves to increase the total density of the apparatus 10 and attached weight 64 when the apparatus is used in a well or borehole containing a relatively dense liquid, and/or to increase the rate of descent through a fluid in the borehole.

At this point the apparatus 10 is positioned at the desired predetermined depth in the borehole or well, with the tracer agent or other material still sealed within the inner cylinder 12. The tracer agent is released by a weight 68 that is disposed concentrically along the suspension line 62. While the weight 68 is illustrated as a frustoconical solid in the drawings, the shape or configuration of the weight 68 is not critical so long as it possesses sufficient mass to actuate the apparatus 10 as described below. Larger and/or more streamlined weights may be incorporated, as desired.

The weight 68 remains at the surface as the apparatus 10 is lowered into the borehole or well. Once the apparatus 10 is positioned at the desired depth, the weight 68 is dropped and it slides down the line 62. When the weight 68 strikes the top wall 34 of the outer cylinder 14, it jars or displaces the outer cylinder 14 downward around the inner cylinder 12, which cannot move vertically due to its attachment to the suspension line 62. The outer cylinder 14 is displaced downward by the force of the weight 68 until its top wall 34 strikes the upper edge of the top extension 18 of the inner cylinder 12. This configuration also results in the various ports 42*a* through 44*b* of the outer cylinder 14 aligning with the corresponding ports 28*a* through 30*b* of the inner cylinder 12, generally as shown in FIG. 2B, to release the tracer agent contained within the inner cylinder 12. Once the tracer agent has been released from its container 32 within the inner cylinder 12, the apparatus 10 may be lifted back to the surface by means of the flexible line 62 and reconfigured for reuse as desired.

It is to be understood that the present invention is not limited to the embodiments described above, but encompasses any and all embodiments within the scope of the following claims.

I claim:

1. A bore hole tracer injection apparatus, comprising:

an inner cylinder having a closed top wall, a bottom wall with a filler port disposed therethrough, and a circumferential side wall, the side wall having a plurality of ports disposed therethrough, the top wall, the bottom wall, and the side wall of the inner cylinder defining a tracer agent container therein; and an outer cylinder having a top wall, an open bottom, and a circumferential side wall, the side wall having a plurality of ports disposed therethrough, the outer cylinder being selectively installed over the inner cylinder, the outer cylinder selectively positioned over the inner cylinder to align the ports of the outer cylinder with the ports of the inner cylinder, wherein the tracer agent container of the inner cylinder is sealed by the side wall of the outer cylinder when the ports of the outer cylinder and the ports of the inner cylinder are misaligned with one another, and by a plug removably installed within the filler port of the bottom wall of the inner cylinder.

2. The bore hole tracer injection apparatus according to claim 1, further comprising:

the inner cylinder having a top immediately above the closed top wall thereof;

the top wall of the outer cylinder having a line clearance passage disposed therethrough;

a flexible line extending through the line clearance passage of the top wall of the outer cylinder and attaching to the top of the inner cylinder; and a weight disposed concentrically upon the line, whereby the weight is selectively dropped down the line to impact the top wall of the outer cylinder, thereby jarring the outer cylinder downward about the inner cylinder so as to align the ports of the side wall of the outer cylinder with the ports of the side wall of the inner cylinder.

3. The bore hole tracer injection apparatus according to claim 2, further comprising a rod disposed diametrically across the top of the inner cylinder above the closed top wall thereof, the rod extending outward through ports of the outer cylinder, the flexible line being attached to the rod.

4. The bore hole tracer injection apparatus according to claim 2, further comprising a secondary weight removably depending from the inner cylinder.

5. The bore hole tracer injection apparatus according to claim 1, further comprising:

the circumferential side wall of the inner cylinder having an outer surface, the outer surface having a plurality of circumferentially disposed sealing ring grooves formed therearound, each of the sealing ring grooves having a sealing ring installed therein; and the circumferential side wall of the outer cylinder having an inner surface, the inner surface having a plurality of circumferentially disposed sealing ring grooves formed therearound, each of the sealing ring grooves having a sealing ring installed therein, the sealing rings of the inner cylinder frictionally sealing against the inner surface of the outer cylinder, the sealing rings of the outer cylinder frictionally sealing against the outer surface of the inner cylinder.

6. The bore hole tracer injection apparatus according to claim 1, further comprising:

the inner cylinder having two diametrically opposed upper ports and two diametrically opposed lower ports; and the outer cylinder having two diametrically opposed upper ports and two diametrically opposed lower ports, the ports of the inner cylinder being aligned with the ports of the outer cylinder when the inner cylinder is completely contained within the outer cylinder.

7. A bore hole tracer injection apparatus, comprising:

an inner cylinder having a circumferential side wall and a top, the side wall having a plurality of ports disposed there through;

an outer cylinder having a top wall and a circumferential side wall, the top wall having a line clearance passage disposed therethrough, the side wall having a plurality of ports disposed therethrough, the outer cylinder being selectively installed over the inner cylinder, the outer cylinder selectively positioned over the inner cylinder to align the ports of the outer cylinder with the ports of the inner cylinder;

a flexible line extending through the line clearance passage of the top wall of the outer cylinder and attaching to the top of the inner cylinder; and a weight disposed concentrically upon the line, whereby the weight is selectively dropped down the line to impact the top wall of the outer cylinder, thereby jarring the outer cylinder downward about the inner cylinder so as to align the ports of the side wall of the outer cylinder with the ports of the side wall of the inner cylinder.

8. The bore hole tracer injection apparatus according to claim 7, wherein the inner cylinder has a closed top wall immediately below the top thereof and a bottom wall with a filler port disposed therethrough, the top wall, the bottom wall, and the side wall of the inner cylinder defining a tracer agent container therein, and the outer cylinder having an open bottom, the inner cylinder installing within the outer cylinder through the open bottom of the outer cylinder.

9. The bore hole tracer injection apparatus according to claim 8, further comprising a rod disposed diametrically across the top of the inner cylinder above the closed top wall thereof, the rod extending outward through ports of the outer cylinder, the flexible line being attached to the rod.

10. The bore hole tracer injection apparatus according to claim 8, wherein the tracer agent container of the inner cylinder is sealed by the side wall of the outer cylinder when the ports of the outer cylinder and the ports of the inner cylinder are misaligned with one another, and by a plug removably installed within the filler port of the bottom wall of the inner cylinder.

11. The bore hole tracer injection apparatus according to claim 7, wherein the circumferential side wall of the inner cylinder has an outer surface, the outer surface having a plurality of circumferentially disposed sealing ring grooves formed therearound, each of the sealing ring grooves having a sealing ring installed therein, and the circumferential side wall of the outer cylinder having an inner surface, the inner surface having a plurality of circumferentially disposed sealing ring grooves formed therearound, each of the sealing ring grooves having a sealing ring installed therein, the sealing rings of the inner cylinder frictionally sealing against the inner surface of the outer cylinder, the sealing rings of the outer cylinder frictionally sealing against the outer surface of the inner cylinder.

12. The bore hole tracer injection apparatus according to claim 7, wherein the inner cylinder has two diametrically opposed upper ports and two diametrically opposed lower ports, and the outer cylinder having two diametrically opposed upper ports and two diametrically opposed lower ports, the ports of the inner cylinder being aligned with the ports of the outer cylinder when the inner cylinder is completely contained within the outer cylinder.

13. The bore hole tracer injection apparatus according to claim 7, further comprising a secondary weight removably depending from the inner cylinder.

14. A bore hole tracer injection apparatus, comprising:

an inner cylinder having a circumferential side wall with an outer surface, the outer surface having a plurality of circumferentially disposed sealing ring grooves formed therearound, each of the sealing ring grooves having a sealing ring installed therein, the side wall having a plurality of ports disposed therethrough, the side wall of the inner cylinder defining a tracer agent container therein; and an outer cylinder having a circumferential side wall with an inner surface, the inner surface having a plurality of circumferentially disposed sealing ring grooves formed therearound, each of the sealing ring grooves having a sealing ring installed therein, the sealing rings of the inner cylinder frictionally sealing against the inner surface of the outer cylinder, the sealing rings of the outer cylinder frictionally sealing against the outer surface of the inner cylinder, wherein the side wall of the outer cylinder has a plurality of ports disposed therethrough, the outer cylinder being selectively installed over the inner cylinder, the outer cylinder selectively positioned over the inner cylinder to align the ports of the outer cylinder with the ports of the inner cylinder, wherein the inner cylinder has a top with a closed top wall immediately therebelow and a bottom wall with a filler port disposed therethrough, the top wall, the bottom wall, and the side wall of the inner cylinder defining a tracer agent container therein, and the outer cylinder having an open bottom, the inner cylinder installing within the outer cylinder through the open bottom of the outer cylinder.

15. The bore hole tracer injection apparatus according to claim 14, wherein the tracer agent container of the inner cylinder is sealed by the side wall of the outer cylinder when the ports of the outer cylinder and the ports of the inner cylinder are misaligned with one another, and by a plug removably installed within the filler port of the bottom wall of the inner cylinder, and a secondary weight is removably attached to the plug.

16. The bore hole tracer injection apparatus according to claim 14, further comprising:

the inner cylinder having a top with a closed top wall immediately therebelow;

the outer cylinder having a top wall with a line clearance passage disposed therethrough;

a flexible line extending through the line clearance passage of the top wall of the outer cylinder and attaching to the top of the inner cylinder; and a weight disposed concentrically upon the line, whereby the weight is selectively dropped down the line to impact the top wall of the outer cylinder, thereby jarring the outer cylinder downward about the inner cylinder so as to align the ports of the side wall of the outer cylinder with the ports of the side wall of the inner cylinder.

17. The bore hole tracer injection apparatus according to claim 16, further comprising a rod disposed diametrically across the top of the inner cylinder above the closed top wall thereof, the rod extending outward through ports of the outer cylinder, the flexible line being attached to the rod.

18. The bore hole tracer injection apparatus according to claim 14, wherein the inner cylinder has two diametrically opposed upper ports and two diametrically opposed lower ports, and the outer cylinder having two diametrically opposed upper ports and two diametrically opposed lower ports, the ports of the inner cylinder being aligned with the ports of the outer cylinder when the inner cylinder is completely contained within the outer cylinder.

* * * * *